US011738475B2

(12) United States Patent
Boehmer et al.

(10) Patent No.: US 11,738,475 B2
(45) Date of Patent: Aug. 29, 2023

(54) WINDSHIELD REMOVAL TOOL

(71) Applicants: Daniel Boehmer, Port Charlotte, FL (US); Connie M. Ciccarone, Port Charles, FL (US)

(72) Inventors: Daniel Boehmer, Port Charlotte, FL (US); Christopher Ciccarone, Port Charlotte, FL (US)

( * ) Notice: Subject to any disclaimer, the term of this patent is extended or adjusted under 35 U.S.C. 154(b) by 221 days.

(21) Appl. No.: 16/693,266

(22) Filed: Nov. 23, 2019

(65) Prior Publication Data

US 2020/0086518 A1 Mar. 19, 2020

Related U.S. Application Data

(63) Continuation-in-part of application No. PCT/US2018/034711, filed on May 25, 2018.

(60) Provisional application No. 62/511,071, filed on May 25, 2017.

(51) Int. Cl.

| | |
|---|---|
| ***B26B 27/00*** | (2006.01) |
| ***B26D 1/547*** | (2006.01) |
| ***B25B 27/00*** | (2006.01) |

(52) U.S. Cl.

CPC ..... *B26B 27/002* (2013.01); *B25B 27/0035* (2013.01); *B26D 1/547* (2013.01)

(58) Field of Classification Search

CPC ... B25B 27/0035; B26B 27/002; B26D 1/547; B26D 7/2614

See application file for complete search history.

(56) References Cited

U.S. PATENT DOCUMENTS

| | | | | |
|---|---|---|---|---|
| 4,958,395 A * | 9/1990 | Busskohl | B23D 61/121 | 403/334 |
| 8,099,869 B2 * | 1/2012 | Hess | B26D 1/547 | 30/116 |
| 2008/0012349 A1 * | 1/2008 | Finck | B26B 27/002 | 292/70 |
| 2010/0132201 A1 * | 6/2010 | Klabunde | B26B 27/002 | 30/277.4 |

* cited by examiner

*Primary Examiner* — Stephen Choi

(74) *Attorney, Agent, or Firm* — Allen F. Bennett; Bennett Intellectual Property

(57) ABSTRACT

A windshield removal tool has elongate arm with a claw at its distal end. The device also includes a winch actuated by a motor at the proximal end of the arm. When a cutting wire is positioned along an adhesive bead about a periphery of a fixed glass or panel, the cutting wire is threaded through a puncture in the adhesive bead and attached to the winch. The claw engages a location along the adhesive bead as the winch wines in the cutting wire. A pulley near the distal end of the arm guides the wire. The device may be removed from an initial anchored position and anchored at a new position by removing the claw and placing it at another point along the periphery.

8 Claims, 9 Drawing Sheets

WINDSHIELD REMOVAL TOOL

CROSS-REFERENCE TO RELATED APPLICATIONS

This application is a continuation in part of International application PCT/US2018/034711 filed on May 25, 2018 and claims priority to U.S. Provisional Application Ser. No. 62/511,071 filed on May 25, 2017, the contents of which are hereby incorporated in their entirety.

STATEMENT REGARDING FEDERALLY SPONSORED RESEARCH OR DEVELOPMENT

Not Applicable.

THE NAMES OF PARTIES TO A JOINT RESEARCH AGREEMENT

Not Applicable

INCORPORATION-BY-REFERENCE OF THE MATERIAL SUBMITTED ON A COMPACT DISC

Not Applicable.

COPYRIGHT NOTICE

Not Applicable

BACKGROUND OF THE INVENTION

Field of the Invention

The present invention relates to a device for removing fixed glass or panels. More particularly, the invention relates to a device for cutting through an adhesive bead around an automobile fixed glass or panel the is anchored against an automobile frame proximal to the action of a cutting wire through the adhesive bead.

Description of the Related Art

One common method of removing a fixed glass or panel uses a cutting wire, e.g. a cutting wire, to cut through the adhesive around the periphery of the fixed glass or panel. On one side of the fixed glass or panel, the cutting wire is positioned along the entire periphery of the fixed glass or panel and anchored. The cutting wire on the opposite side of the fixed glass or panel is pulled so that it cuts through the adhesive around the fixed glass or panel. This is not always easy to do and requires a large amount of force.

In addition, most devices for pulling the cutting wire through the adhesive bead are anchored on the fixed glass or panel itself. If a fixed glass or panel is cracked or broken, the pressure on the fixed glass or panel caused by anchoring a removal device often results in further cracking or breaking of the fixed glass or panel. This is both dangerous and messy.

In addition, substantial force is often required to pull the cutting wire through the adhesive bead along the entire periphery. Winding devices or pulling devices must therefore be securely anchored. Current methods usually include the use of one or more suction cups or similar mechanisms. These can be difficult and time-consuming to adjust the position of.

The above-described deficiencies of today's systems are merely intended to provide an overview of some of the problems of conventional systems, and are not intended to be exhaustive. Other problems with the state of the art and corresponding benefits of some of the various non-limiting embodiments may become apparent upon review of the following detailed description.

In view of the foregoing, it is desirable to provide a fixed glass or panel removing tool that does not place undue pressure on a fixed glass or panel being removed. It is also desirable to provide a windshield removal tool that may be quickly and easily anchored.

BRIEF SUMMARY OF THE INVENTION

Disclosed is a windshield removing tool that acquires leverage by anchoring on an adhesive bead surrounding a fixed glass or panel to be removed. The tool has a flattened claw at the end of an arm that securely anchors the device but is also easily removed and reattached at different locations.

In one embodiment, a windshield removal tool comprises a body having a handle and housing a motor. A winch attached to the handle and motor has a spool actuated by the motor. An elongate arm extends from the body of the device. A flattened claw has at least one prong and is located at the distal end of the arm. A pulley is positioned near the claw. A cutting wire is guided by the pulley and wound about the spool.

It is therefore an object of the present invention to provide a windshield removal tool that may be anchored only on the adhesive bead and is easily moved from one position along the bead to another with minimal effort.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE SEVERAL VIEWS OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
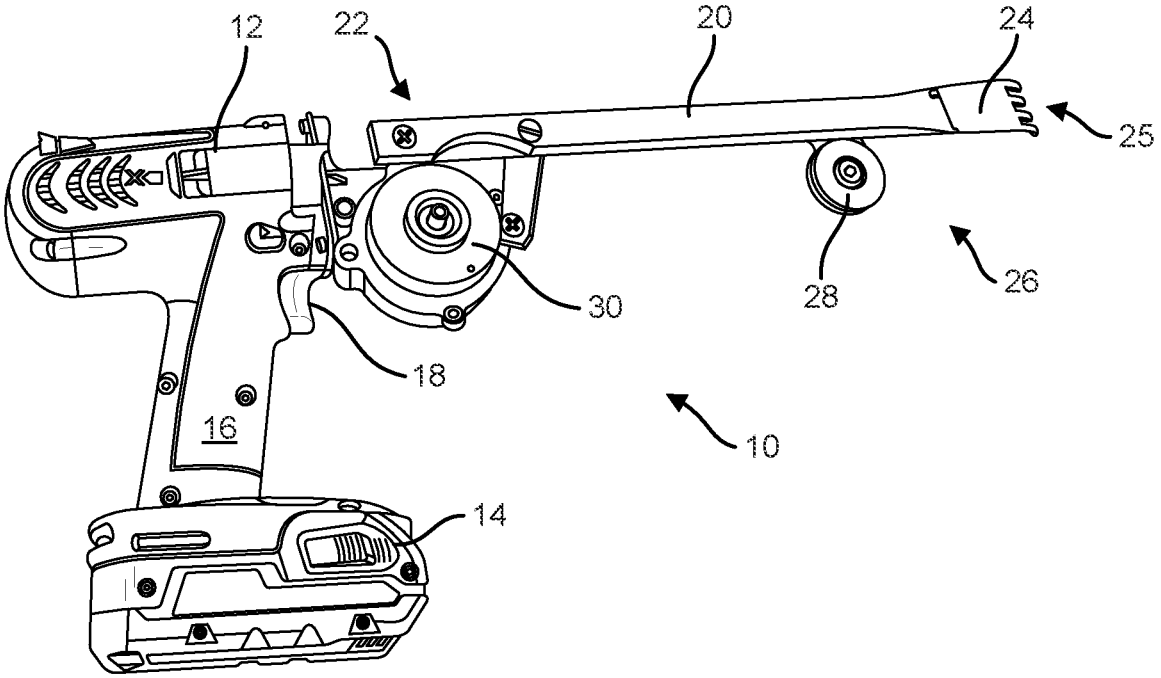
FIG. 1 is a side view of a windshield removal tool in accordance with the principles of the invention.
Figure 2:
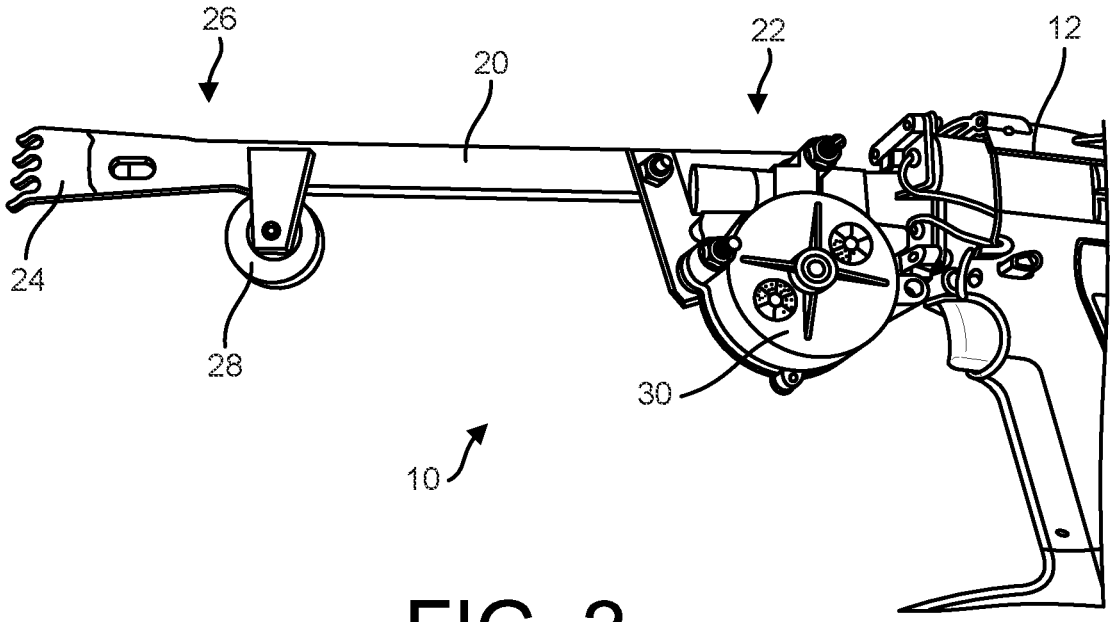
FIG. 2 is a side view of a windshield removal tool in accordance with the principles of the invention.
Figure 3:
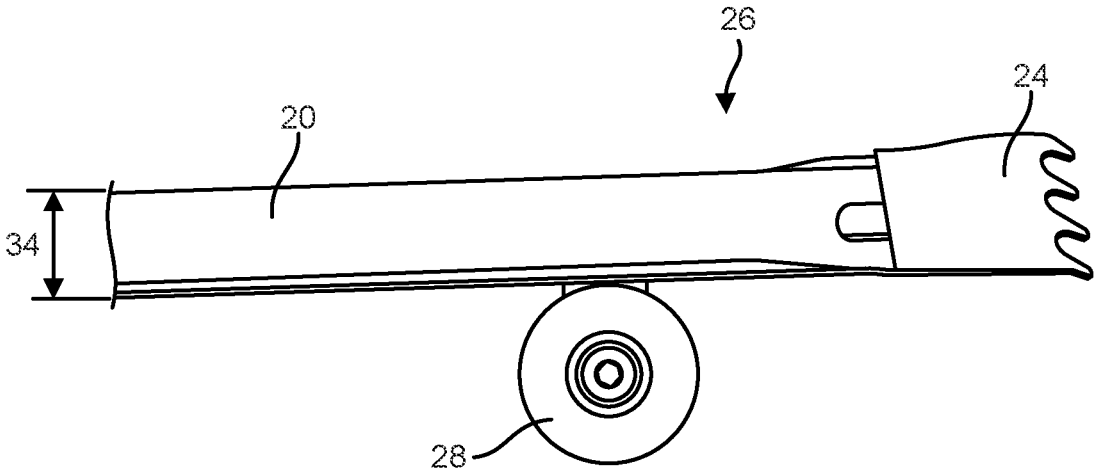
FIG. 3 is a side view of an arm of a windshield removal tool in accordance with the principles of the invention.
Figure 4:
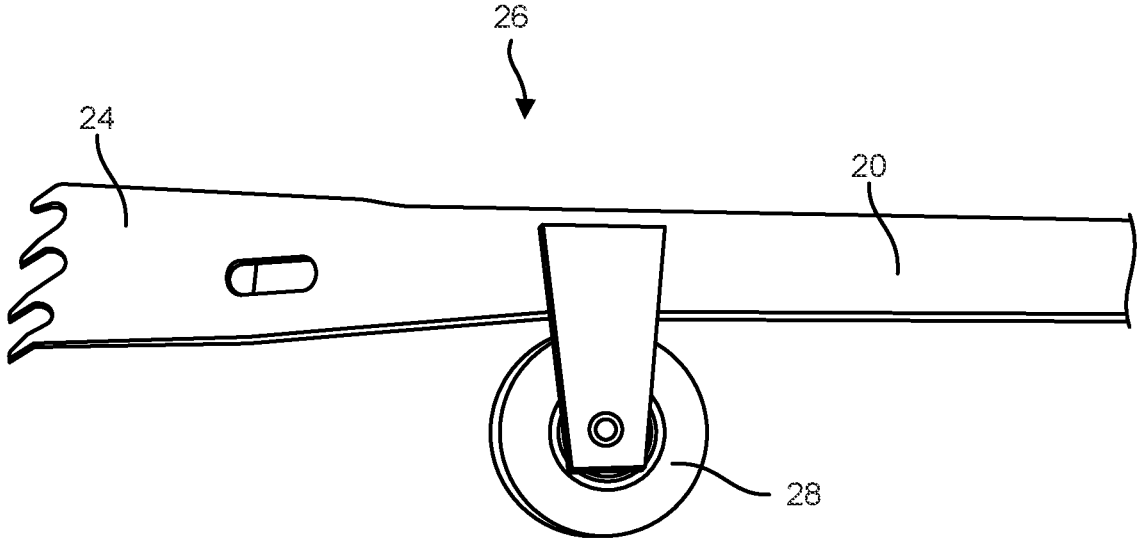
FIG. 4 is a side view of an arm of a windshield removal tool in accordance with the principles of the invention.
Figure 5:
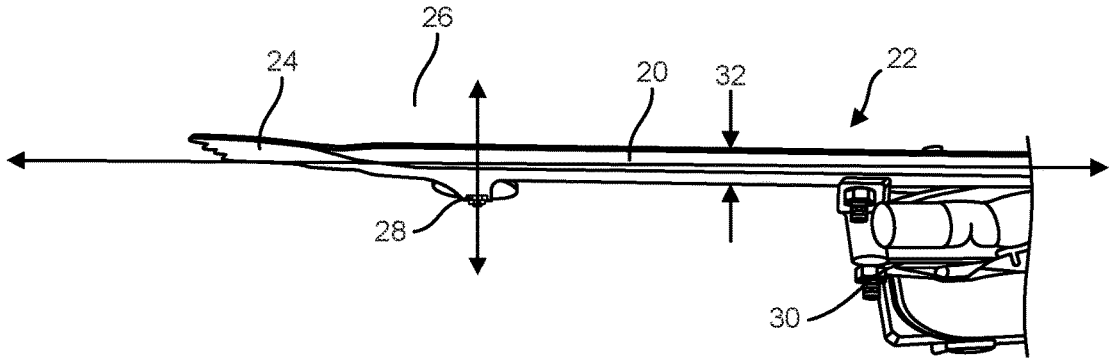
FIG. 5 is a top view of an arm of a windshield removal tool in accordance with the principles of the invention.
Figure 6:
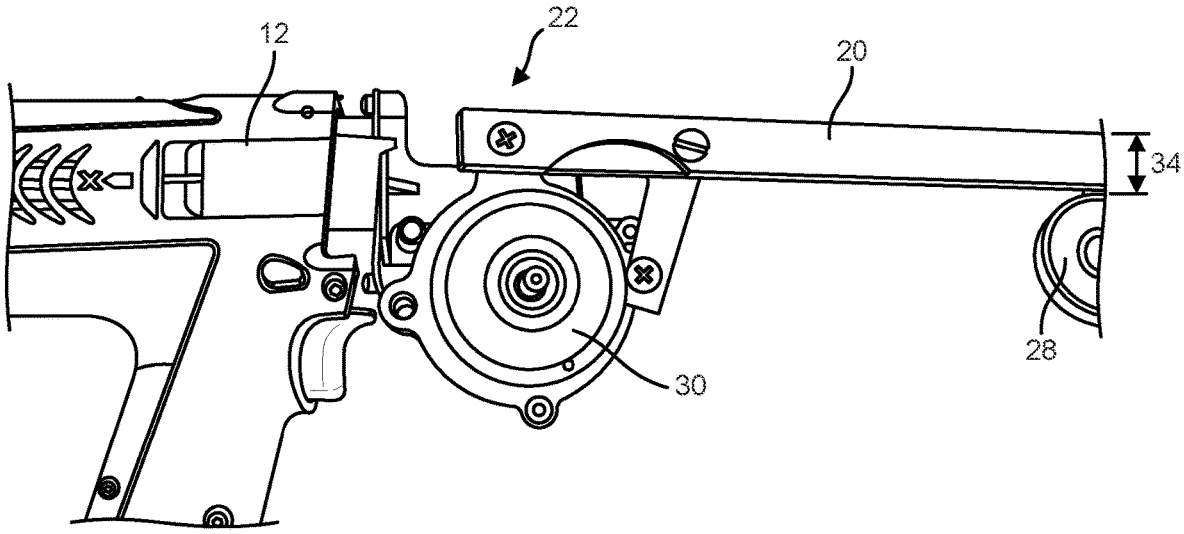
FIG. 6 is a side view of a windshield removal tool in accordance with the principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

This invention is designed to help pull the cutting element, such as a cutting wire, through the adhesive bead along the periphery of a windshield or another fixed glass panel. The proximal end of the cutting wire is attached to the spool of the winch and extends through a portion of the circumferential channel of the guide pulley. The distal end of the cutting wire fed through an opening created in an adhesive bead along the periphery of the windshield. The cutting wire is then drawn through the opening in the bead and placed along the entire length of the bead on the side opposite to the windshield removing tool. The distal end of the cutting wire is then anchored proximate to the opening in the bead. To create leverage, the claw is dug into the adhesive bead. As the cutting wire is retracted by the winch, it creates a tear in the adhesive bead from the opening in a direction toward the point where the claw is dug into the adhesive bead. When tear extends to a point proximal to the claw, the claw is repositioned further along the bead and the process is repeated. In the following description, the invention is described generally in reference to a windshield. However, those skilled in the art will appreciate that the invention disclosed herein may be used for removing any glass panel or other large panel held in place by a peripheral bead of adhesive. For example, many fixed auto glass panels are attached to a vehicle, boat, airplane or other object using similar peripheral bead attachment mechanisms and the invention is suitable for removing such glass panels. Furthermore, other panels of fiberglass, plastic, lucite, stone or other materials may also be separated from other components to which they are attached by like mechanisms utilizing the principles of the invention.

FIGS. 1-6 show a windshield removing tool 10 in accordance with the principles of the invention. The windshield removing tool 10 has a body 12 which has a handle 16 and which houses a motor 14. In this embodiment, the motor 14 is positioned at a first end 18 of the body 12 and is an electric motor powered by a battery 22 located at a second end 20 of the body 12. The handle 16 extends from the first end 18 to the second end 20 of the body 12. The handle 16 includes a trigger 17 for actuating the motor. Optionally, the motor may be housed within the handle 16. The windshield removing tool 10 may also include additional control mechanisms for adjusting the speed, direction and power of the motor. In this embodiment, the handle 16 extends along a vertical axis 19 extending from the first end 18 to the second end 20 of the body 12.

An elongate arm 22 is attached to the body 12 of the windshield removing tool 10. The elongate arm extends from its proximal end 24, which is attached to the body 12, to its distal end 26, thereby defining a longitudinal direction 28 away from the body 12. The elongate arm 22 is said to define a longitudinal direction 28, rather than a longitudinal axis because the arm 22 may be curved rather than straight.

The longitudinal direction 28 may therefore be defined by an arc rather than a straight line. The longitudinal direction 28 extends in a direction, straight or curved, substantially away from the body 12. In this embodiment, the longitudinal direction 28 is straight and substantially perpendicular to the vertical axis 19 of the body 12. The longitudinal direction 28 in this embodiment is not parallel to the vertical axis 19.

The distal end 26 of the arm 22 includes a claw 30 extending substantially in the longitudinal direction 28. A guide pulley 32 is positioned proximal to the distal end 26 of the elongate arm 22. The guide pulley 32 is a wheel 34 having a circumferential channel 36 configured for receiving a cutting wire and rotates freely about an axle 38. The guide pulley 32 is configured so that its plane of rotation is tangential to the longitudinal direction 28. Therefore, when the longitudinal direction 28 is a straight line, the plane of rotation of the guide pulley 32 is parallel to the longitudinal direction 28. The plane of rotation of the guide pulley 32 may also be parallel to the vertical axis 19. FIGS. 1-4 show a guide pulley 32 whose plane of rotation is parallel to the both the longitudinal direction 28 and the vertical axis 19. In this embodiment, the axle 38 is rotatably attached to a gusset plate 40 extending from the elongate arm 22. The gusset plate 40 is substantially parallel to the longitudinal direction 28. In this embodiment, the gusset plate 40 is also substantially parallel to the vertical axis 19 and perpendicular to the axle 38.

A winch 42 is attached to the body 12 proximal to the proximal end 24 of the elongate arm 22. The winch 42 includes a spool 44 having an axle 46 actuated by the motor within the motor housing 14. The spool 24 includes a peripheral channel 48 for storing a cutting wire (shown in FIGS. 7-8) which may be extracted or retracted by actuating the motor. The spool's plane of rotation is the same as the plane of rotation of the guide pulley 32. In this embodiment, the plane of rotation of the spool 44 is parallel to both the vertical axis 19 and the longitudinal direction 28. Optionally, the spool 44 and guide pulley 32 may have different planes of rotation. It is generally preferred for the vertical axis 19 and the longitudinal direction 28 to lie in the plane of rotation of both the spool 44 and the guide pulley 32. The winch may include a gear box 43 connecting it to the motor 14.

In this embodiment, the guide pulley 32 is positioned below the elongate arm 22. Optionally, the guide pulley 32 may be located inside or above the elongate arm 22, but preferably remains proximal to the distal end 26 of the arm 22. Optionally, the pulley 28 may be replaced with a curved channel so long as the cutting wire has sufficiently low frictional shear force with the material from which the channel is fabricated. For example, the cutting wire may extend through a channel inside the arm 20 and the distal end 26 of the arm 20 may have a curved opening from which the cutting wire extends. If the curved opening and the cutting wire produce relatively little friction, a pulley may be unnecessary. Optionally, the plane of rotation of the guide pulley 32 may not be parallel to the elongate arm 22.

Referring to FIGS. 3-6, in this embodiment both the elongate arm 22 and the claw 30 are flattened such that they lie substantially within a plane defined by the longitudinal direction 28 and the vertical axis 19; the arm 22 has a height 27 substantially greater than its width of 29. This configuration gives the arm 22 increased rigidity that prevents the arm 22 from bending within the plane of rotation of the guide pulley 32. During operation, the forces applied to the device 10 are generally within the plane of rotation of the guide pulley 32.

In this embodiment, the winch 42 is positioned at the proximal end 24 of the arm 22 such that it is proximal to the motor within the motor housing 14 which actuates its axle 46. Optionally, the winch 30 may be positioned at the distal end 26 of the arm 22. In such a configuration, a pulley 32 would be unnecessary. Optionally, the motor may be positioned somewhere on the arm 22 itself, in the middle of the arm 20 or at the distal end 26. The claw 30 of this embodiment has four prongs 31 that curve slightly out of the plane of rotation of the guide pulley 32. Optionally, the prongs 31 of the claw 30 may be straight, not curved. Optionally, the claw 30 may be rotatably attached to the distal end 26 of the arm 20.

Figure 7:
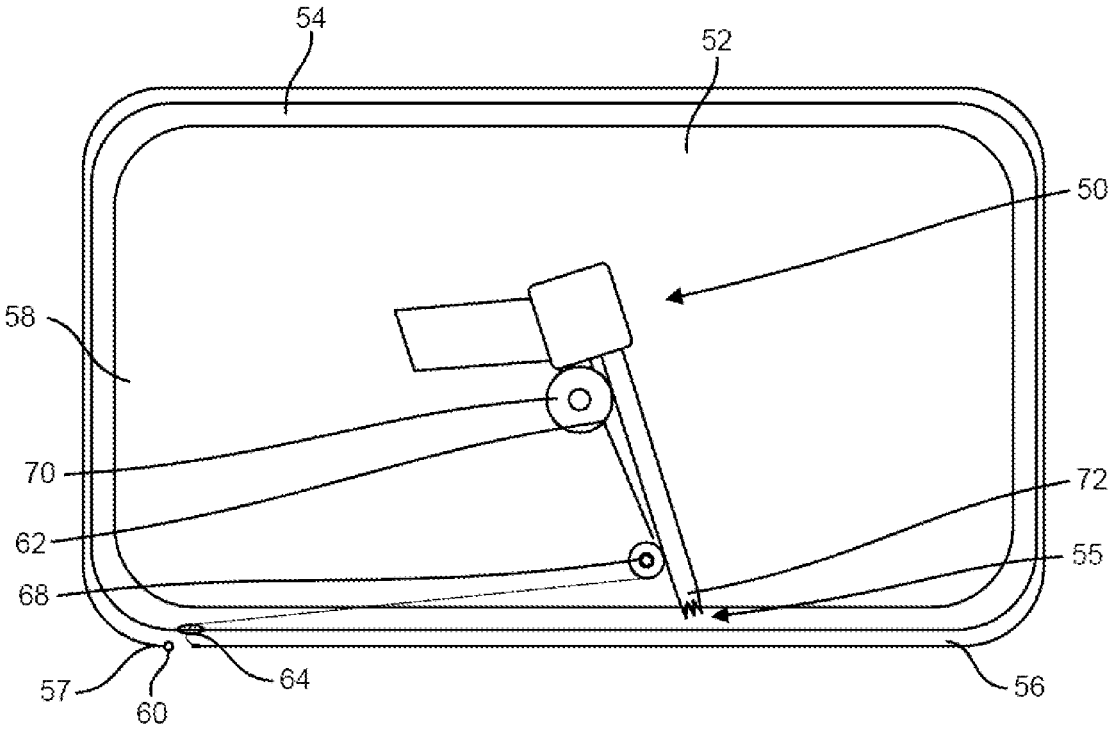
FIG. 7 is a top view of a windshield removal tool affixed to an initial position on a fixed glass or panel in accordance with principles of the invention.
Figure 8:
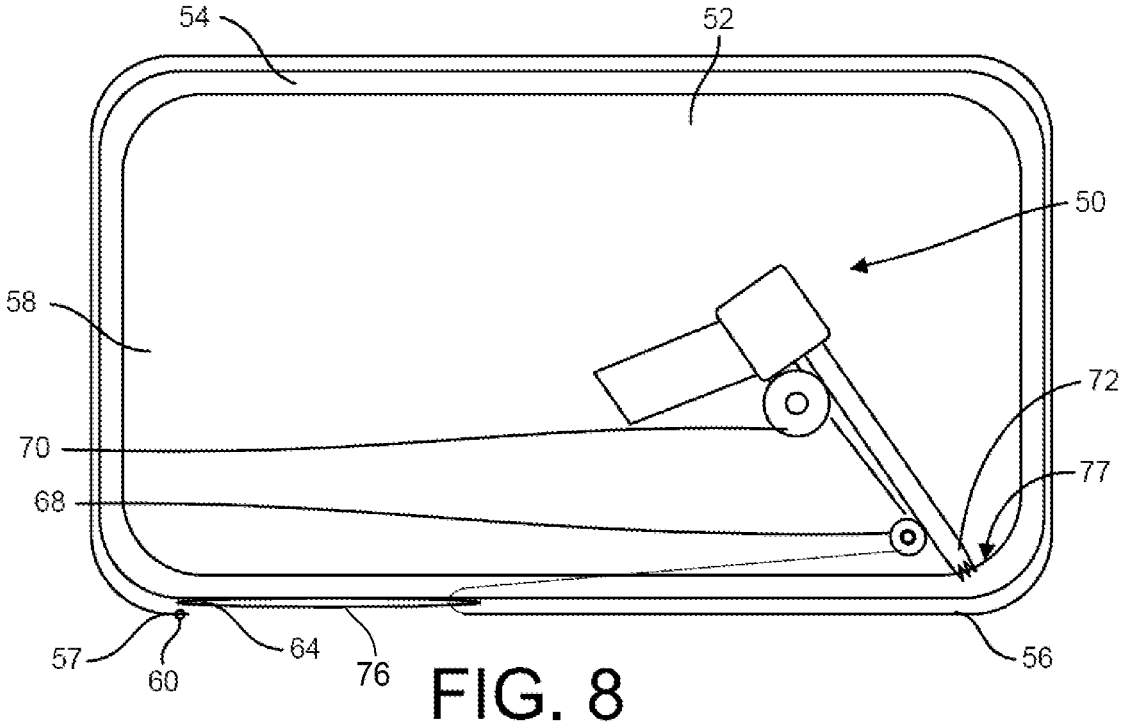
FIG. 8 is a top view of a windshield removal tool affixed to a subsequent position on a fixed glass or panel in accordance with principles of the invention.

FIGS. 7-8 show a method of using a windshield removing tool 50 in accordance with the principles of the invention. A windshield, or other fixed panel, 52 is surrounded by an adhesive bead 54. To remove the windshield 52, the adhesive bead 54 must be sliced through. As is appreciated by those skilled in the art, a common method for cutting through the bead is to use a strong, thin cutting wire such as a metal cutting wire 56 pulled to tear through the adhesive bead, thus separating the windshield 52 from its setting. In accordance with the principles of the invention, a first end 57 of the cutting wire 56 is attached to an anchor 60 on a first side of the windshield 52. The anchor 60 remains firmly in place through the process, securing the first end 57 of the cutting wire 56. The cutting wire 56 is then placed along and substantially parallel to the adhesive bead 54 around the entire periphery 58 to the windshield 52. The adhesive bead 54 is then punctured to form a hole 64 and the distal end 62 of the cutting wire 56 is threaded through the hole 64.

Once the distal end 62 of the cutting wire 56 has been threaded through the hole 64, it is then pulled over the pulley 68 and affixed to the winch 70. The claw 72 is then placed against the adhesive bead 54 at a first tool anchor point 55 located on the bead 54 in the desired direction of the tear through the bead 54. This anchors the windshield removing tool 50 at the first tool anchor point 55. The tool 50 includes a motor for actuating the winch as described above. As the winch 70 begins spooling, or rolling up, the cutting wire 56 is retracted, creating a tear 76 in the adhesive bead 54 along the periphery 58 beginning at the hole 64.

The cutting wire 56 is drawn in by the winch 70 until the tear 76 has extended along the periphery 58 to a location proximal to the first tool anchor point 55. At this time, the claw 72 is removed from the first tool anchor point 55 and repositioned so that the claw 72 impinges upon the bead 54 at a subsequent tool anchor point 77 located in the direction of the desired tear. The winch 70 is again actuated to draw in the cutting wire 56, thereby extending the tear 76, until the tear 76 is once again proximal to the subsequent tool anchor point 77. The process, placing the claw at a subsequent anchor point, retracting the wire to lengthen the tear, and moving the claw to a subsequent anchor point, is repeated until the cutting wire 56 has been drawn through the bead 54 around the entire periphery 58 of the windshield 52 such that the tear extends to the anchor 60, allowing the windshield 52 to be removed.

Because the claw 72 is anchored by impinging only upon the bead 54, the amount of force applied to both the windshield 52 and the surrounding vehicle body is minimized or eliminated. The windshield removing tool of the invention only applies force to the adhesive bead, and does not apply force to the windshield itself. As a result, a cracked or broken windshield is substantially less likely to shatter during the fixed glass or panel removal process. Because the device 50 uses a claw 72 instead of suction cups or other mechanisms, the device 50 may be securely anchored to even a relatively narrow object such as the adhesive bead 54. The use of a claw 72 also allows for easy, rapid and efficient detachment and reattachment to the bead 54. This allows the position of the device 52 change quickly and easily, and to be easily adjusted during use.

Figure 9:
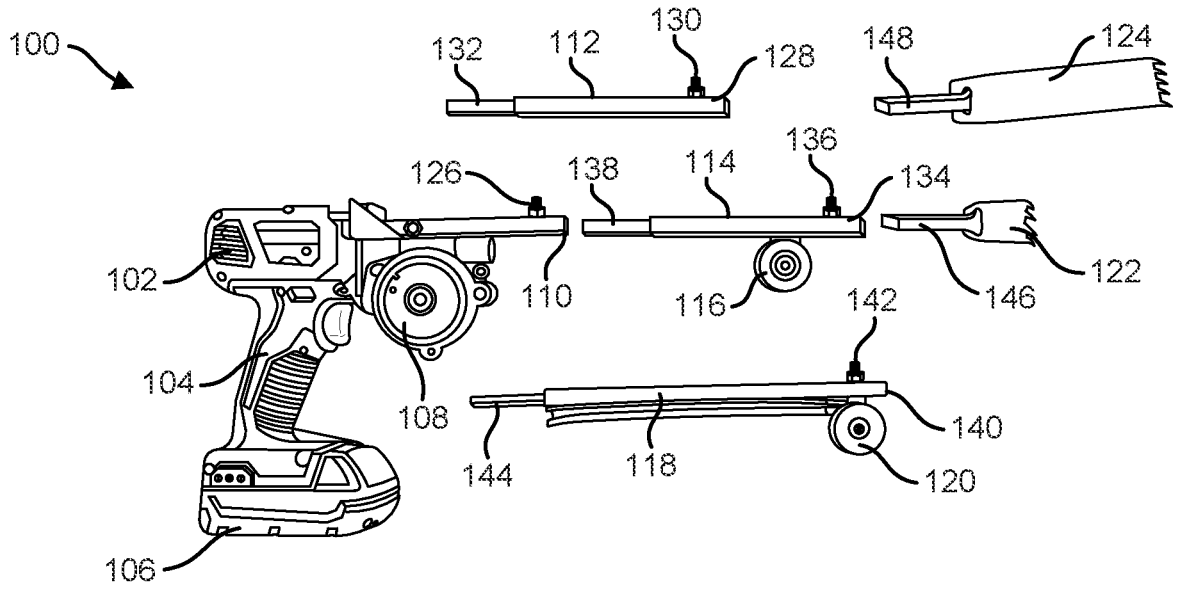
FIG. 9 is an exploded perspective view of an alternative embodiment of a windshield removal tool having interchangeable accessories in accordance with the principles of the invention.

FIG. 9 shows an alternative embodiment of a windshield removing tool having interchangeable accessories 100. The fixed glass or panel removing winch 100 includes a body 102 housing a motor and having a handle 104, an interchangeable battery 106 and a docking sleeve 110. Several interchangeable accessory components are designed to be removably secured to the docking sleeve 110. In this embodiment, these accessories include a basic extension arm 112, an extension arm 114 including a pulley 116, a curved extension arm 118 having a pulley 120, a basic claw 122 and an elongate claw 124. The docking sleeve 110 includes a locking mechanism 126 that secures attachment of one of the accessories. In this embodiment, the locking mechanism is a screw that may be twisted until it impinges upon a connecting bolt inserted into the docking sleeve.

The simple extension arm 112 includes a docking sleeve 128 having a locking mechanism 130 at its distal end, and a connecting bolt 132 at its proximal end. The extension arm 114 includes a docking sleeve 134 having a locking mechanism 136 at its distal end, and a connecting bolt 138 at its proximal end. The curved extension arm 118 includes a docking sleeve 140 having a locking mechanism 142 at its distal end, and a connecting bolt 144 at its proximal end. The basic claw 122 likewise includes a connecting bolt 146 at its proximal end, and the elongate claw 124 has a connecting bolt 148 at its proximal end.

Figure 10:
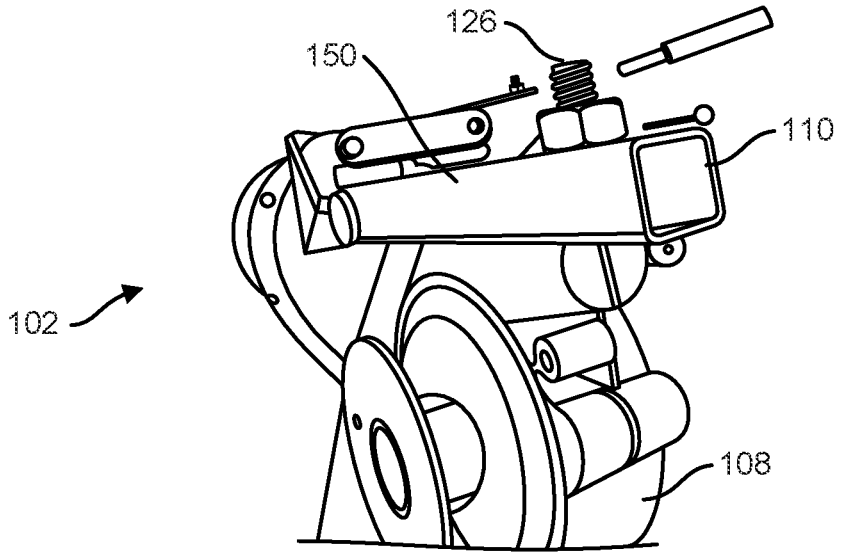
FIG. 10 is a perspective view of a mounting boss of an alternative embodiment of a windshield removal tool in accordance with the principles of the invention.
Figure 11:
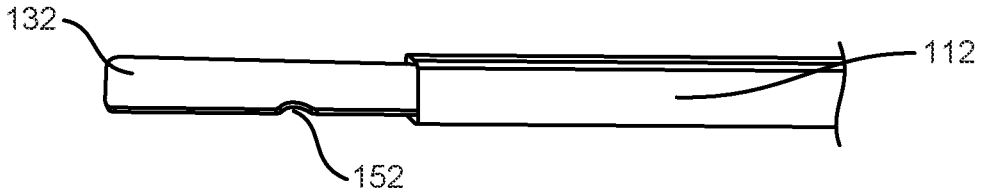
FIG. 11 is a side view of a connecting bolt of an extension arm of the alternative embodiment of a windshield removal tool in accordance with the principles of the invention.

FIG. 10 shows the docking sleeve 110 in more detail. In this embodiment, the docking sleeve 110 is keyed by having a square cross-section, which ensures that an accessory is properly aligned when attached. The docking sleeve 110 is located at a distal end of a truncated arm 150. FIG. 11 shows the connecting bolt 132 of the basic extension arm 112. The connecting bolt 132 includes a notch 152 that engages the locking mechanism 126 of the are 150, thereby securing the extension arm 112 in place during use. All of the connecting bolts of the accessories are configured to engage the docking sleeves of the accessories and the arm 150. As a result they are interchangeable and may also be connected in tandem.

Figure 12:
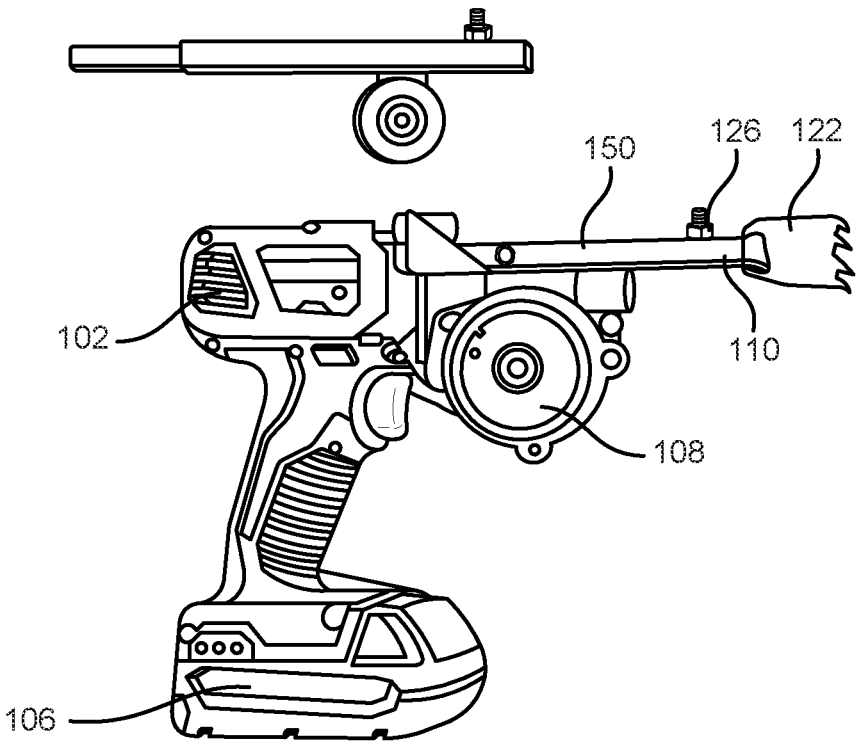
FIG. 12 is a side view of an alternative embodiment of a windshield removal tool having a basic claw attached in accordance with the principles of the invention.
Figure 13:
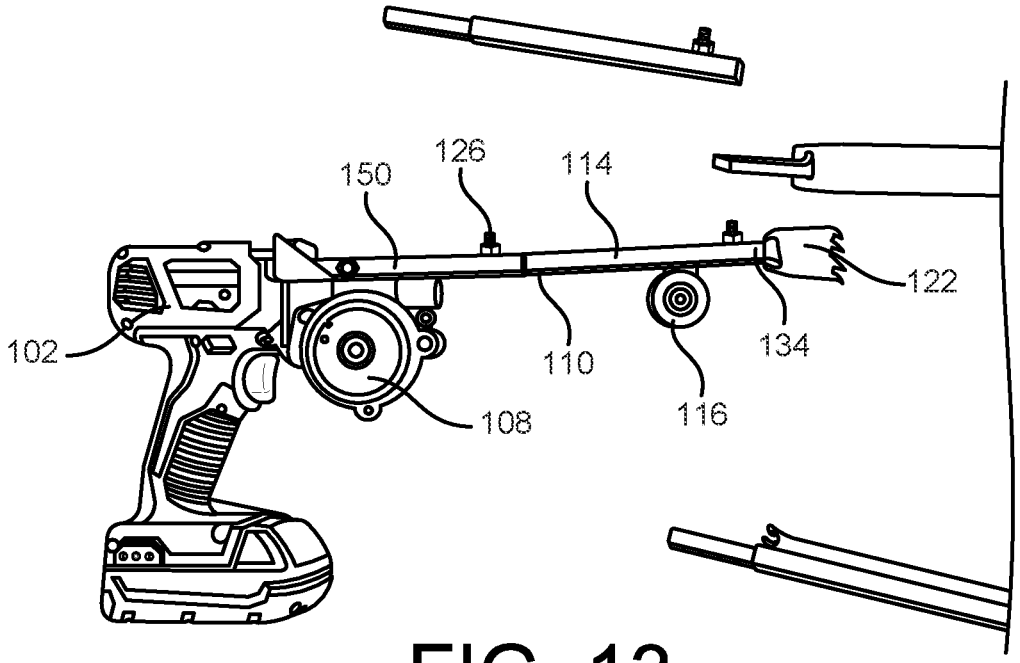
FIG. 13 is a side view of an alternative embodiment of a windshield removal tool having an extension arm and a basic claw attached in accordance with the principles of the invention.

FIG. 12 shows the basic claw 122 connected directly to the shaft 150 by inserting its connecting bolt 146 into the docking sleeve 110. This combination may be desirable when the device is positioned in a relatively small work area providing limited access. FIG. 13 shows the extension arm 114 attached to the docking sleeve 110 and the basic claw 122 attached to the docking sleeve 134 of the extension arm 114. This provides a configuration similar to the windshield removing tool 10 shown in FIGS. 1-6.

Figure 14:
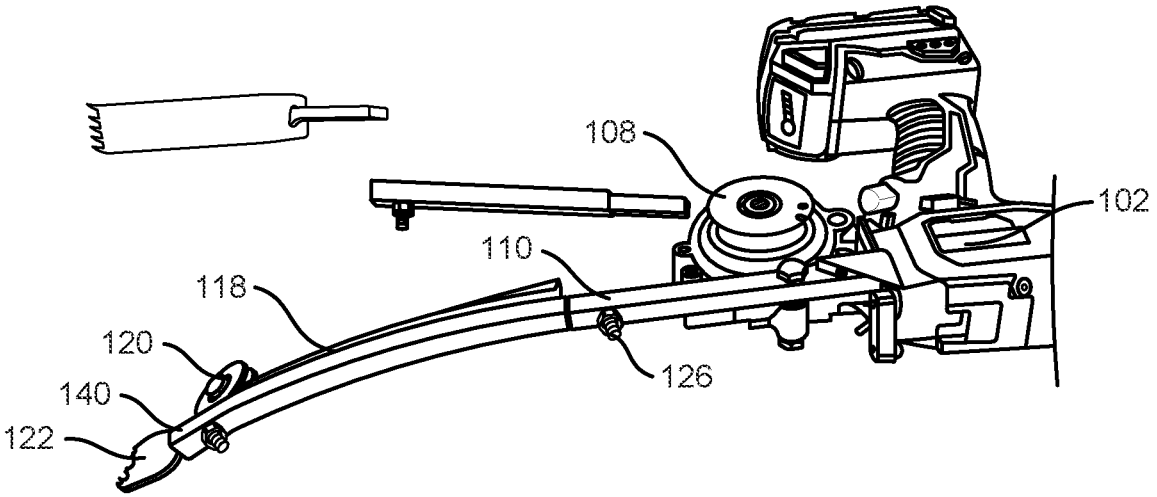
FIG. 14 is a perspective view of an alternative embodiment of a windshield removal tool having a curved extension arm and basic claw attached in accordance with the principles of the invention.
Figure 15:
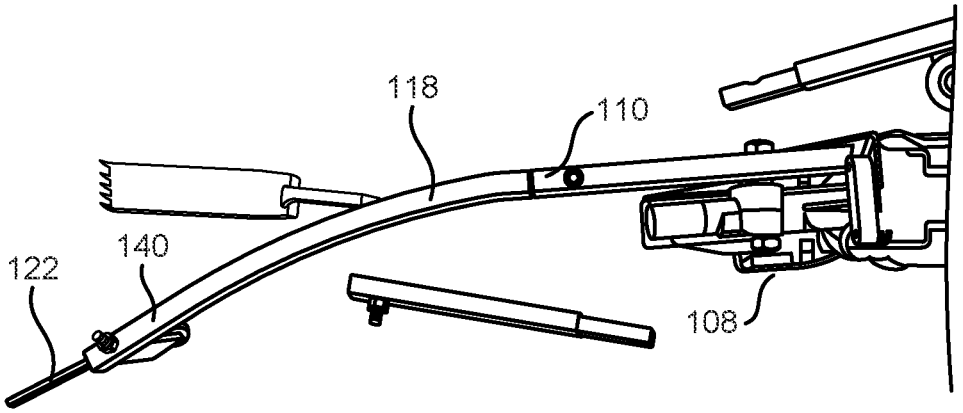
FIG. 15 is a perspective view of an alternative embodiment of a windshield removal tool having a curved extension arm and basic claw attached in accordance with the principles of the invention.
Figure 16:
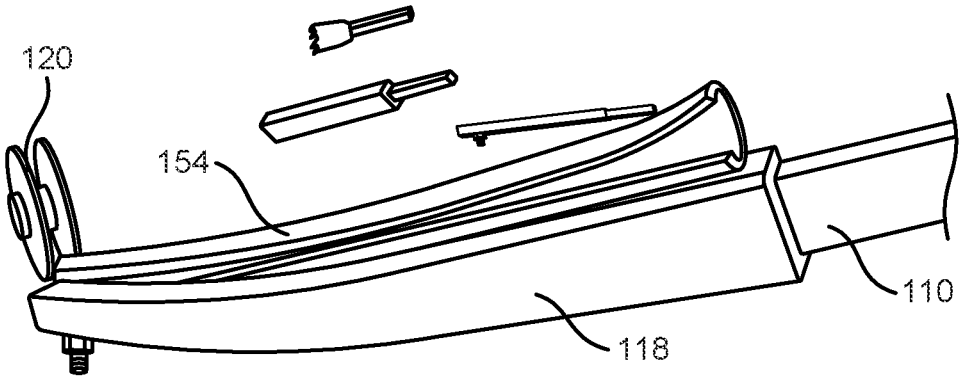
FIG. 16 is a perspective view of an alternative embodiment of a windshield removal tool having a curved extension arm and basic claw attached in accordance with the principles of the invention.

FIGS. 14-16 show the windshield removing tool 100 having the curved extension arm 118 connected to the docking sleeve 110 at its proximal end and connected to the basic claw 122 at its proximal end. The curved extension arm 118 includes a channel 154. In use, the wire used to cut the adhesive bead is fed from the pulley 120 into and through the channel 154 along the curved extension arm 118 to the winch 108. This allows the curved extension arm 118 to be used without the cutting wire impinging on any surfaces or objects that the curved extension arm 118 is used to avoid.

Figure 17:
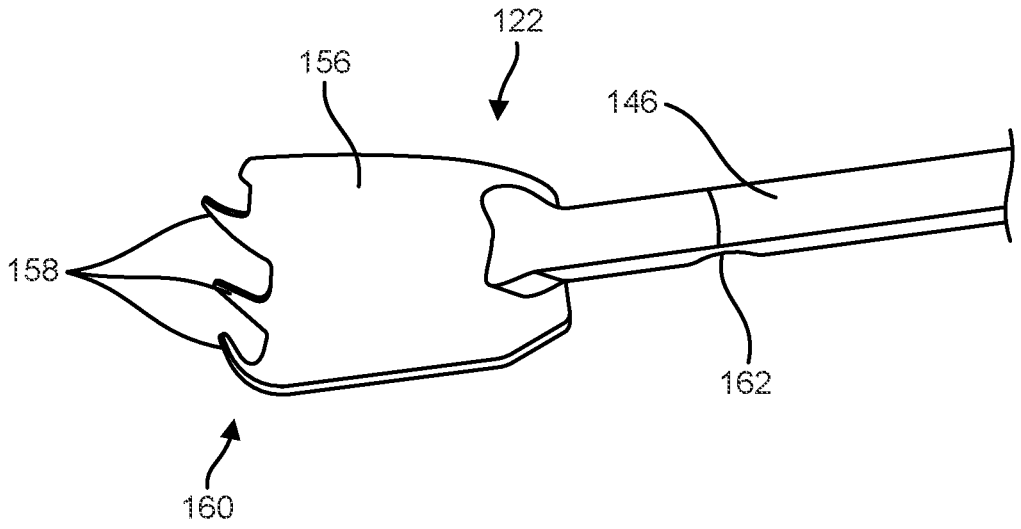
FIG. 17 is a side view of a basic claw of an alternative embodiment of a windshield removal tool in accordance with the principles of the invention.

FIG. 17 shows the basic claw 122 in more detail. The body 156 of the basic claw 122 is substantially planar and has prongs 158 at its distal end 160. The connecting bolt 146 has a square cross-section and includes a notch 162 for engaging any of the locks 126, 130, 136 and 142.

Figure 18:
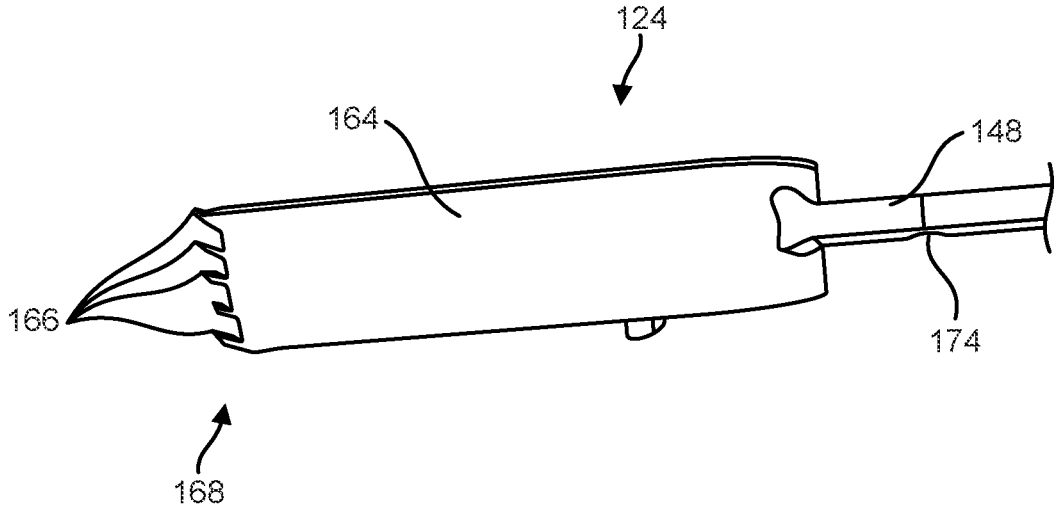
FIG. 18 is a side view of an elongate claw of an alternative embodiment of a windshield removal tool in accordance with principles of the invention.

FIG. 18 shows the elongate claw 124 in more detail. The elongate claw 124 has an elongate body 164 with a plurality of prongs 166 at its distal end 168. The connecting bolt 148 has a square cross-section and includes a notch 174 engaging any of the locking mechanisms. Both claws 122 and 124 include a plurality of curved prongs. Because the bolts and mounting bosses are keyed with symmetric, square cross-sections, the claws 122 and 124 may be inserted into the mounting bosses in multiple orientations. The directions of the claws and the orientation of the horizontal bodies may be rotated with respect to the shaft 150.

Figure 19:
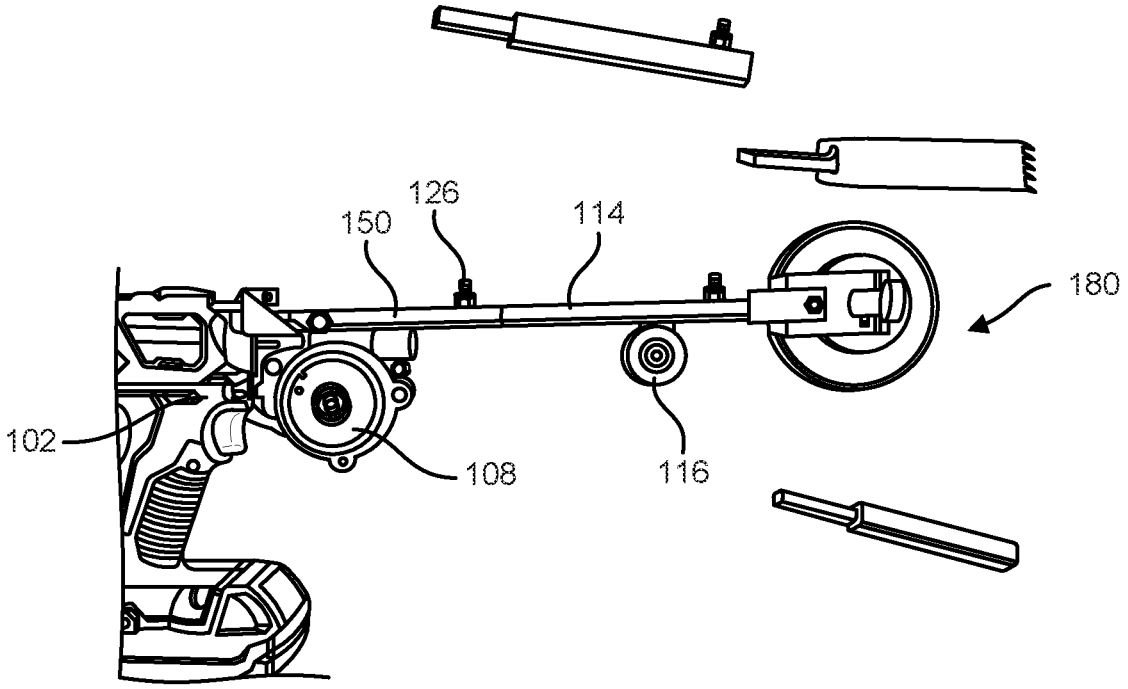
FIG. 19 is a side view of an alternative embodiment of a windshield removal tool having an extension arm and a suction cup attached in accordance with the principles of the invention.
Figure 20:
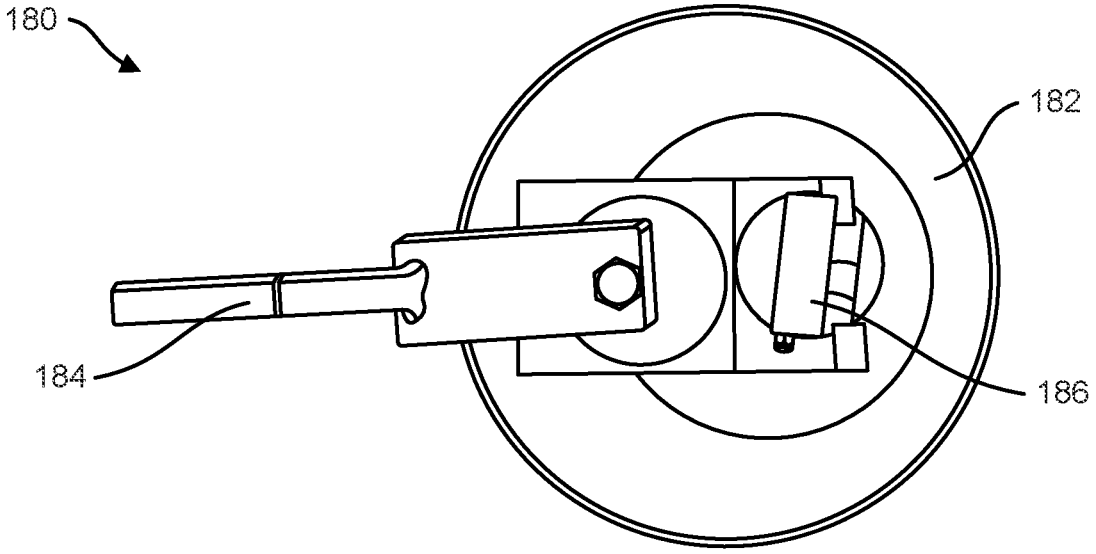
FIG. 20 is a side view of a suction cup accessory for an alternative embodiment of a fixed glass or panel device in accordance with the principles of the invention.

FIGS. 19 and 20 show the windshield removing tool 100 with another alternative accessory, an anchor 180. In this embodiment, the anchor 180 includes a suction cup 182 at its distal end and a connecting bolt 184 at its proximal end. The suction cup 182 includes a release switch 186 that releases the suction cup to whatever surface it has been affixed to.

The windshield removing tool 100 is utilized in substantially the same way as the device shown in FIGS. 1-6. However, it allows an operator to modify the arm of the device by changing its length, shape and mechanism for anchoring itself in position while a cutting wire is being collected on the spool of the winch. The various accessories shown in this embodiment are connected to the device and each other by means of a docking sleeve female connector and a bolt male connector. Those skilled in the art will appreciate that these mechanisms may be inverted. For example, the shaft 150 may include a connecting bolt instead of a docking sleeve, and the accessories may all have docking sleeves at their proximal ends and connecting bolt at their distal ends. Furthermore, the docking sleeves and connecting bolts may be replaced using any suitable mechanism for connecting and interchanging accessory tool heads. The locking mechanisms may use screws or detents configured to engage grooves in the connecting bolt. Optionally, other locking mechanisms may be utilized. In addition, the connections may be keyed and methods different from providing a square cross-section for the docking sleeves and connecting bolts. It may be desirable to utilize a spline or other connector mechanism that prevents rotation of the components of the device during use. Other anchors besides claws and suction cups may also be used at the distal end of the arm. It may also be desirable to utilize several pulleys instead of just one. It may also be desirable to utilize telescoping arms or articulated arms that may or may not be locked into a predetermined position.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A windshield removing tool comprising:

a body housing a motor and having a vertical axis extending through a first end and a second end of the body, and a handle along the vertical axis;

an elongate arm having a proximal end attached to the body and extending in a longitudinal direction away from the body to a distal end, wherein the longitudinal direction is not parallel to the vertical axis of the body;

a claw at the distal end of the elongate arm;

a guiding pulley proximal to the distal end of the elongate arm and having an axle, a circumferential channel, and a plane of rotation tangential to the longitudinal direction of the elongate arm, and circumferential channel;

a winch having a spool, an axle actuated by the motor, and a plane of rotation equal to the plane of rotation of the pulley; and, a cutting wire attached to the spool of the winch and extending through a portion of the circumferential channel of the guide pulley;

wherein the cutting wire is wound around the spool of the winch when the motor actuates the axle of the winch.

2. The windshield removing tool of claim 1 wherein the claw lies within the plane of rotation of the guide pulley and includes prongs that extend partially outside the plane of rotation of the guide pulley.

3. The windshield removing tool of claim 2 wherein the prongs extend from the claw in a direction between zero and 45° away from the plane of rotation of the guide pulley.

4. The windshield removing tool of claim 1 wherein the elongate arm is straight.

5. The windshield removing tool of claim 1 wherein the elongate arm is curved.

6. The windshield removing tool of claim 1 wherein the arm has a flattened shape and lies within the plane of rotation of the guide pulley.

7. The windshield removing tool of claim 1 wherein the arm is straight.

8. The windshield removing tool of claim 1 wherein the arm is curved.

* * * * *